United States Patent [19]

Peisner et al.

[11] 4,077,330

[45] Mar. 7, 1978

[54] SLIDING PANEL FOR AN END DOOR OF A RAIL CAR

[75] Inventors: Israel D. Peisner, Huntington Woods; Paul J. Ye, Melvindale, both of Mich.

[73] Assignee: Whitehead & Kales Company, River Rouge, Mich.

[21] Appl. No.: 717,176

[22] Filed: Aug. 24, 1976

[51] Int. Cl.[2] ..... B61D 17/06; B61D 19/00

[52] U.S. Cl. ..... 105/410; 49/41; 105/331; 105/368 R; 296/55

[58] Field of Search ..... 105/331, 332, 339, 367, 105/368 R, 378, 410, 329 R, 337, 338; 49/40, 41, 171; 160/97, 113, 114, 116, 237; 296/55, 147, 148, 155,

[56] References Cited

U.S. PATENT DOCUMENTS

| | | | |
|---|---|---|---|
| 1,549,714 | 8/1925 | Claveria | 160/116 |
| 2,739,645 | 3/1956 | Urquhart | 160/116 |
| 3,191,547 | 6/1965 | Adler | 105/378 |
| 3,712,363 | 1/1973 | Thomassen et al. | 160/113 |
| 3,827,182 | 8/1974 | VanHelleputte | 49/40 |
| 3,995,563 | 12/1976 | Blunden | 105/368 R |

*Primary Examiner*—Johnny D. Cherry
*Assistant Examiner*—Carl Rowold
*Attorney, Agent, or Firm*—Whittemore, Hulbert & Belknap

[57] ABSTRACT

An end closure for a rail car which comprises a pair of sliding doors mounted for movement between open and closed positions. One of the doors has a recess to clear a brake lever when the door is open. A panel is provided to close the recess when the door is closed. The panel is automatically moved to a position opening the recess when the door is opened and automatically moved to a position closing the recess when the door is closed.

8 Claims, 10 Drawing Figures

SLIDING PANEL FOR AN END DOOR OF A RAIL CAR

BACKGROUND AND SUMMARY OF THE INVENTION

In United States patent application Ser. No. 582,229 which was filed May 30, 1975, issued as U.S. Pat. No. 3,995,563 and is assigned to the assignee of this application, there is disclosed an end closure for a rail car which is designed to protect the car from illegal or unauthorized entry. That end closure was composed of two sliding doors which when closed extended across the open end of the rail car. However, on some rail cars, one of the doors when open interfered with the operation of the hand brake lever, contrary to railroad regulations.

One object of this invention is to modify one of the doors in a manner such that it will not obstruct or interfere with the operation and use of the rail car hand brake lever. To that end, one of the doors is formed with a recess to clear the brake lever when the door is open. A panel is provided to close the recess when the door is closed.

In accordance with a further object of the invention, mechanism is provided for automatically moving the panel to a position opening the recess when the door is opened and for automatically moving the panel to a position closing the recess when the door is closed.

Other objects and features of the invention will become more apparent as the description proceeds, especially when taken in conjunction with the accompanying drawings wherein.

Referring now more particularly to the drawings, the rail car is generally designated R and is shown as having the elongated longitudinally extending decks A1, A2 and A3, which in this instance are especially adapted for the transport of road vehicles.

Figure 1:
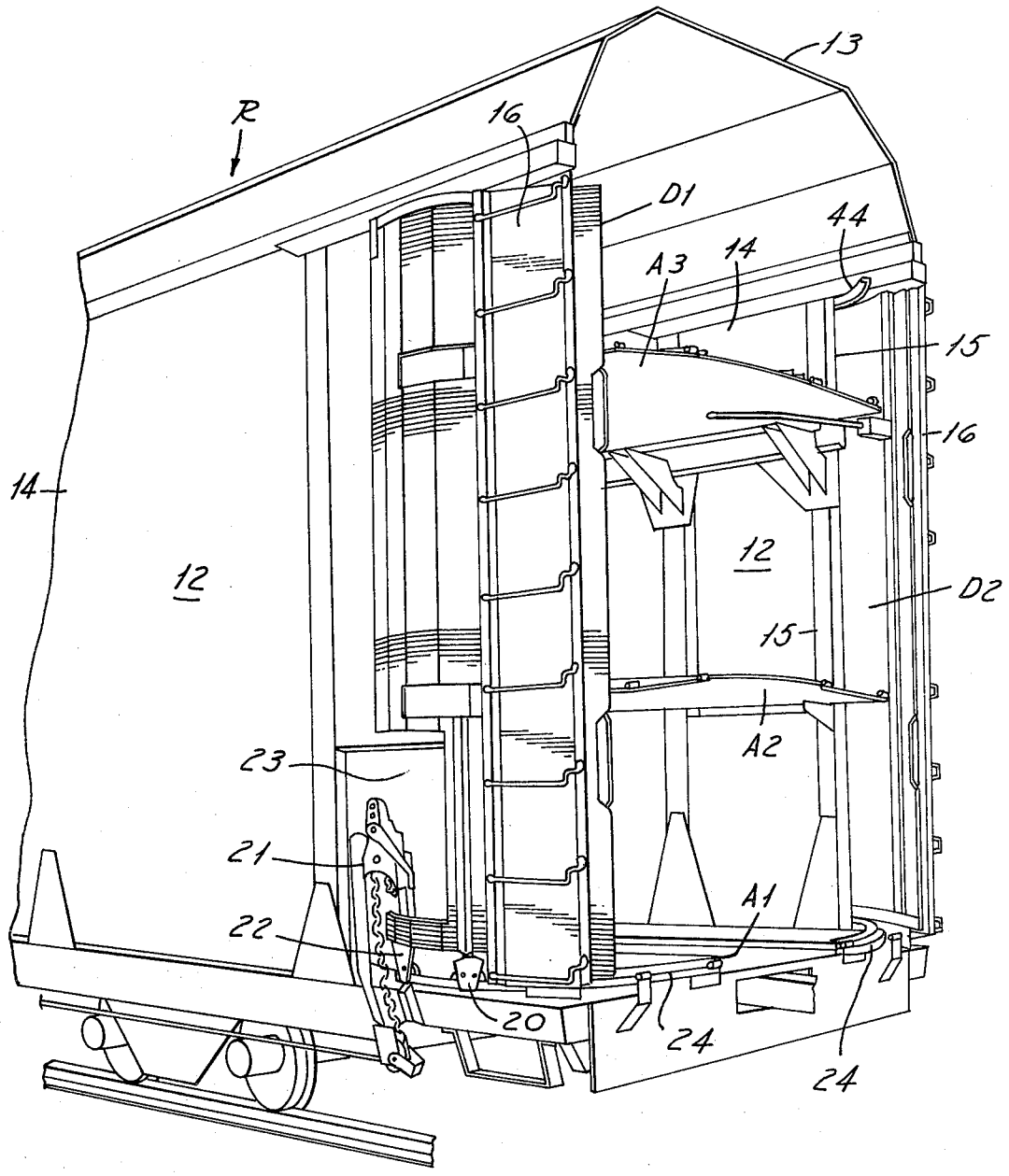
FIG. 1 is a fragmentary perspective view of one end portion of a rail car having an end closure constructed in accordance with the present invention, the end closure comprising doors shown in the open position.
Figure 2:
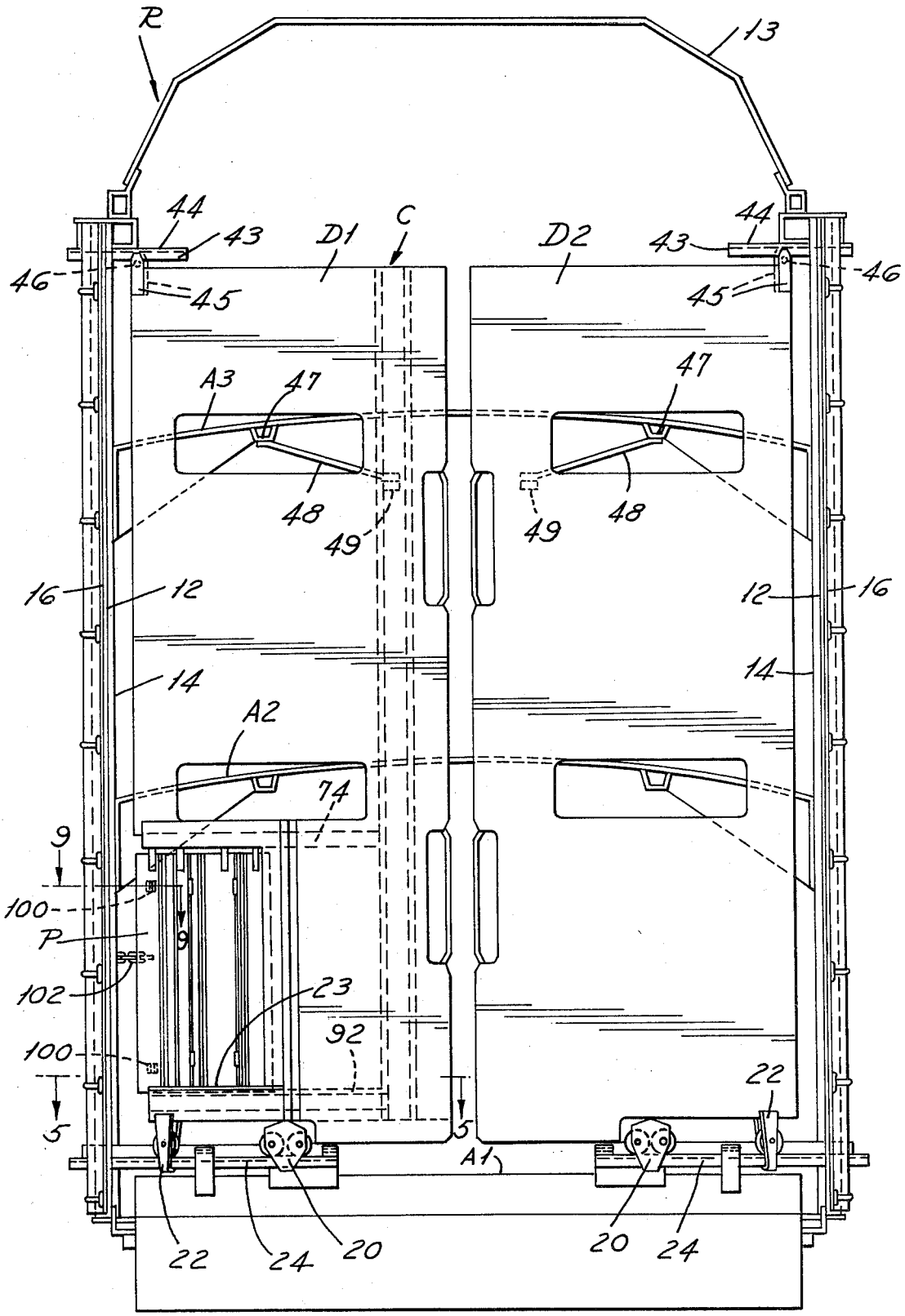
FIG. 2 is an end view of the rail car shown in FIG. 1, showing the doors in closed position.
Figure 5:
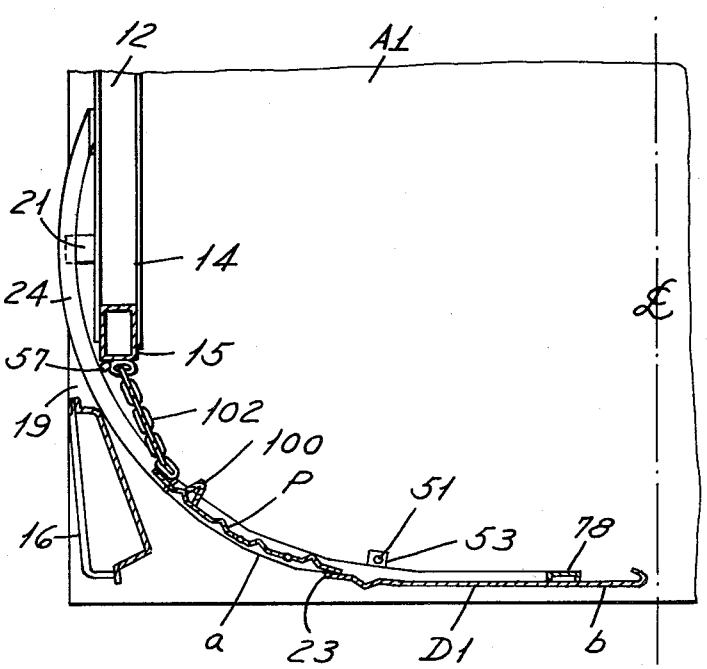
FIG. 5 is a sectional view taken on the line 5—5 in FIG. 2.

The rail car has the side walls 12 and is preferably closed on the top by the roof structure 13 and is open at least at the end shown in FIG. 1. The main portion 14 of each side wall terminates in a vertical edge portion provided by an upright pillar or post 15 located a short distance from the end of the rail car. Each side wall also has an upright panel 16 positioned beyond the main portion 14 which in this case has rungs to enable a workman to climb to the decks A2 and A3. Each panel 16 is spaced laterally outwardly and forwardly of the main portion 14 of the side wall, as will be apparent in FIGS. 5 and 6, and cooperates with the post 15 of the main wall portion 14 in defining a vertical slot or gap 19. The slot or gap 19 in each side wall 12 provides openings for the paths of the doors of the end closure about to be described. A hand brake lever 21 is on the outside of the main portion 14 of one side wall near the post 15 as shown in FIG. 1. Normally there is only one such hand brake lever on a rail car.

The end closure for the end of the rail car is generally designated C and comprises a pair of doors D1 and D2, each adapted to extend across approximately one-half the end of the rail car so that together the two doors provide substantially a full end closure. Except for the recess 23 formed in the door D1 the doors D1 and D2 are mirror images of one another. Accordingly, only the door D1 will be described.

Figure 4:
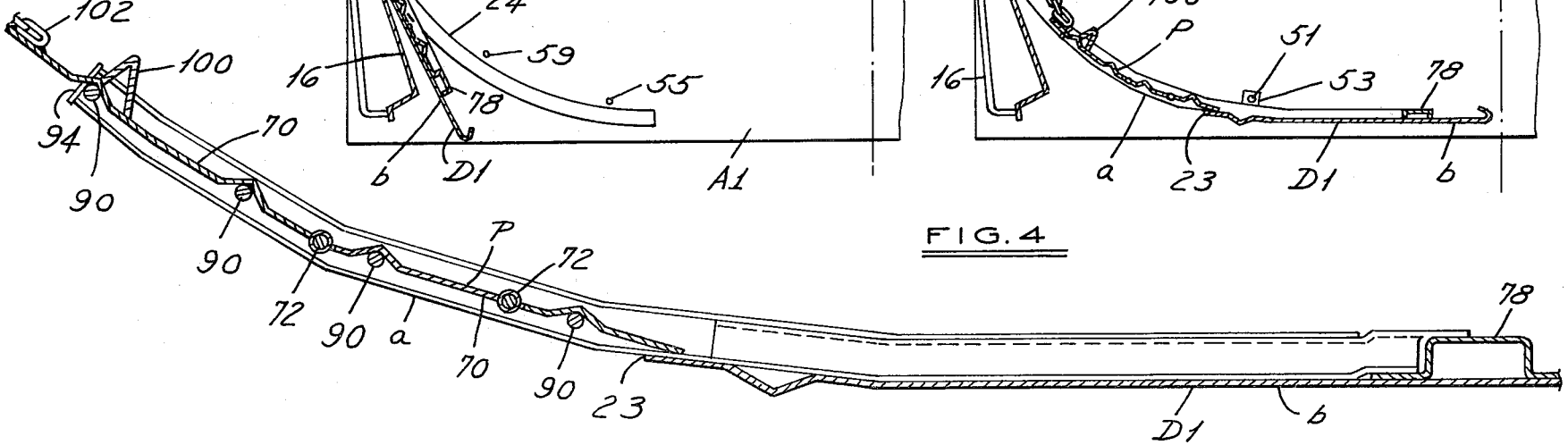
FIG. 4 is a sectional view taken on the line 4—4 in FIG. 3.
Figure 7:
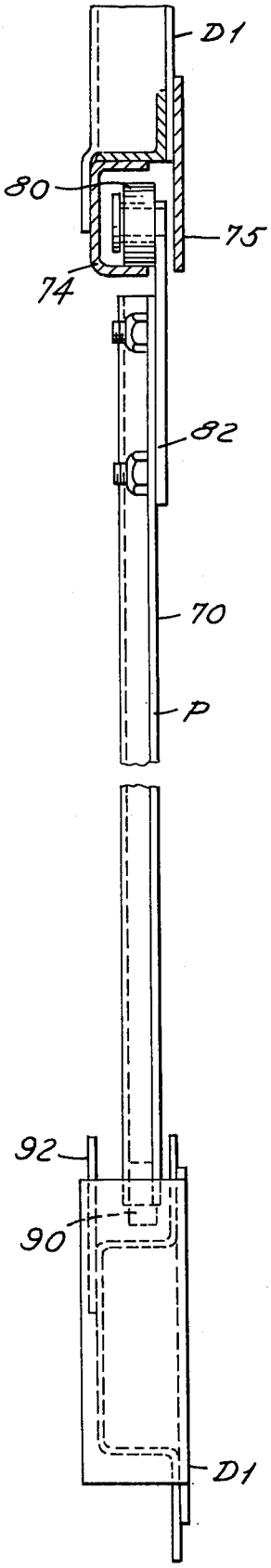
FIG. 7 is a view taken on the line 7—7 in FIG. 3.
Figure 8:
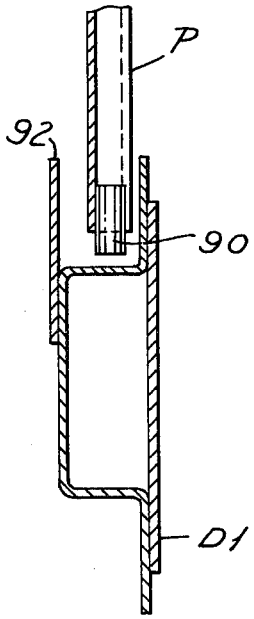
FIG. 8 is a fragmentary sectional view taken on the line 8—8 in FIG. 3.
Figure 9:
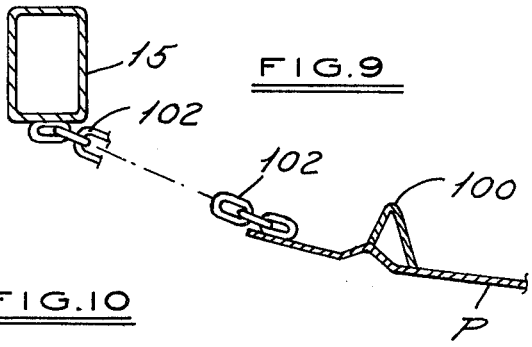
FIG. 9 is a fragmentary sectional view taken on the line 9—9 in FIG. 2.
Figure 10:
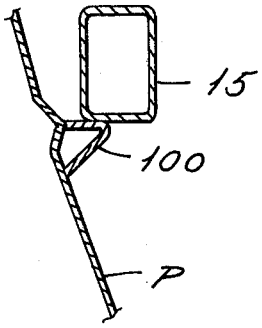
FIG. 10 is a sectional view of the parts shown in FIG. 9 but in a different position.

The door D1 is a vertical panel having the configuration shown in FIG. 4. As there shown, the door D1 has a substantially arcuate laterally outer portion *a* and a straight laterally inner portion *b* which is tangent to the arc of the outer portion *a*. The door D1 is supported for sliding movement from the closed position shown in FIG. 5 to the open position shown in FIG. 6.

The lower edge portion of the door D1 is supported by roller assembles 20 and 22 upon the track structure 24 which has an arcuate form corresponding to the arc of the portion *a* of the door. The track 24 is mounted on deck A1 in the corner of the rail car and extends through the gap 19 in the side wall 12.

The roller assemblies may be of any suitable construction. In the present instance, the roller assembly 20 comprises a roller housing 32 connected to the lower edge portion of the door. One or more rollers 36 are journaled in the housing 32 and roll on the track 24. The housing 32 preferably has a lower edge portion which is bent under the bottom of the track to prevent the door from becoming separated from the track.

The other roller assembly 22 has a roller housing 40 fixed to the lower edge portion of the door which supports a single roller 42. This roller 42 also runs on the track 24 during movement of the door between open and closed positions. The housing 40 also preferably has a lower edge portion which is bent under the track 24 to prevent the door from lifting up.

The upper edge portion of the door may be guided by a guide 44 which is secured to the rail car above deck A3 and which may be of the same arcuate form as the portion *a* of the door and as the track 24. Guide 44 is directly above the track 24 and may be an angle member having a vertical flange 43. It extends through the gap 19. The upper edge of the door may have a pair of spaced upwardly projecting plates 45 between which the flange 43 extends. A roller 46 journaled between the plates 45 is positioned to be engaged by the lower edge of the flange 43.

To further support and guide the upper edge portion of the door during its movement between open and closed positions, an arm 48 may be provided having one end pivoted at 47 to the underside of the deck A3 and is pivoted at the opposite end to a bracket 49 on the door. Pivot 47 is located at the center of the arc of the track 24.

The door D1 is provided with a locking mechanism for locking it in open and closed positions, in this instance being comprised of a lock bolt 51 vertically slidable in a housing 53 on the door and engageable in a socket 55 in the deck A1 to lock the door in closed position and in the socket 57 to lock the door in open position. One or more additional sockets 59 may be provided in the deck for locking the door in intermediate positions.

The door D1 has a recess 23 formed in its outer edge. The recess is located so as to clear the hand brake lever in the open position of the door D1 as shown in FIG. 1. Accordingly, a workman standing on the ladder or elsewhere will have full access to the hand brake lever to operate the same even in the open position of the door. While it is shown as rectangular, the recess can be of any shape which will clear the hand brake lever when the door is open.

When the door D1 is closed, it is desirable to close the recess to bar illegal or unauthorized entry into the rail car. For this purpose, a panel P is provided which is of substantially the same rectangular dimensions as the recess. The panel in this instance is formed of separate vertical panel sections 70 pivoted together by hinges 72. It will be understood, of course, that when the door is closed the hand brake lever is fully accessible for operation.

Figure 3:
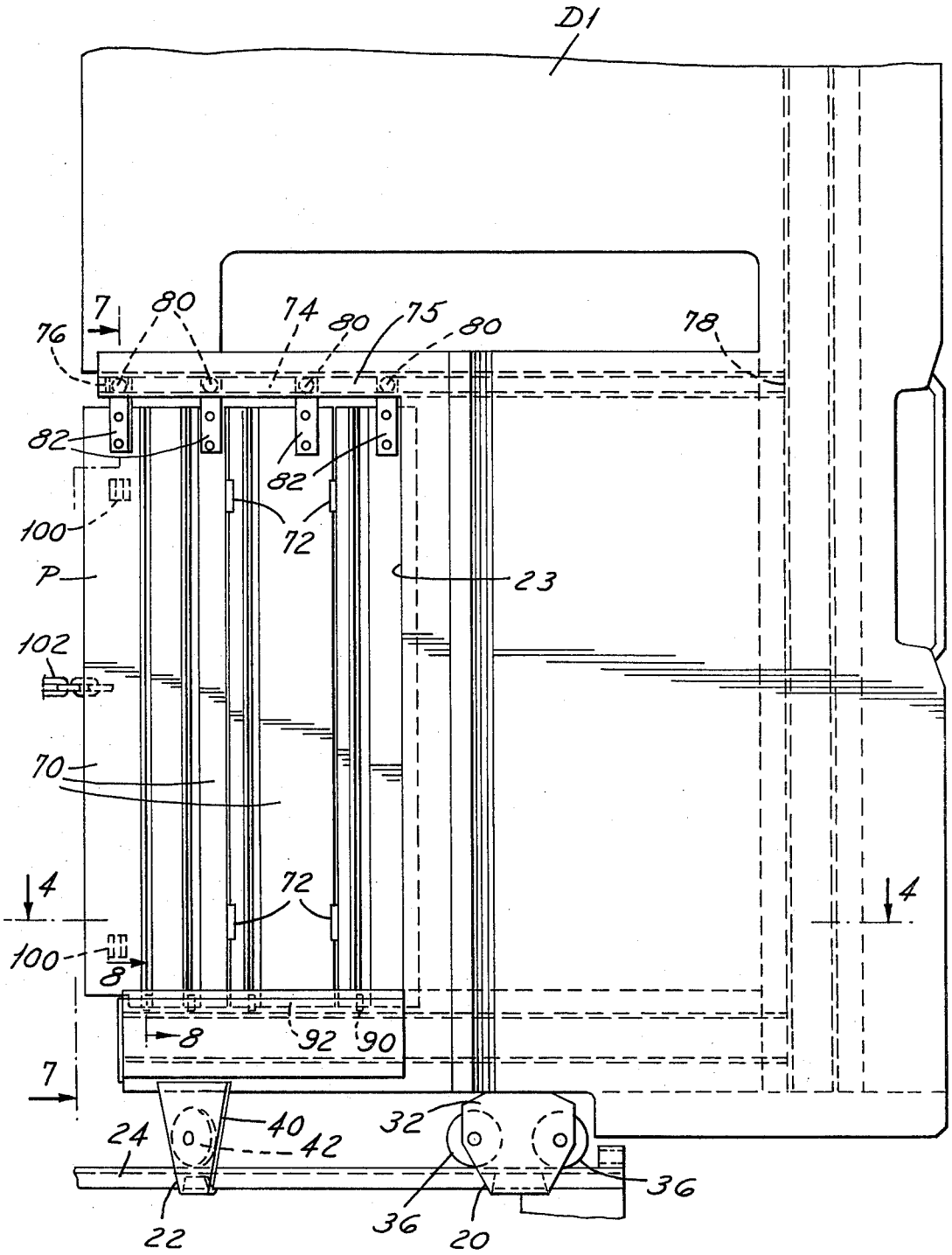
FIG. 3 is an enlarged fragmentary view of a portion of FIG. 2 to more clearly illustrate the panel which closes a recess in one of the doors.

There is a horizontal track guide along the top of the recess provided by the channel 74. This channel extends from the stop 76 adjacent the outer edge of the door past the recess to a vertical door brace 78 near the inner edge of the door, and is thus seen to have a length about twice the width of the recess. Rollers 80 mounted on the panel sections 70 by brackets 82 engage the channel guide 74 to support the panel P for movement from the closed position shown in FIG. 3 to a stored position behind the door in which its inner edge contacts the door brace 78 and it substantially fully exposes the recess. The channel 74 is partially covered by a lip 75 to retain the rollers 80.

The lower edge of the panel has downwardly projecting pins 90 extending into the channel guide 92 along the lower edge of the recess. This channel guide is of approximately the same length as the channel guide 74, extending inward from the stop 94 at its outer end to the vertical door brace 78 to guide the lower edge of the panel during movement of the panel to full open position relative to the recess. The stop 94 at the outer end of the channel guide 92, together with the stop 76, prevents the panel P from moving laterally outward beyond the position shown in FIGS. 3 and 4 in which it fully closes the recess.

Figure 6:
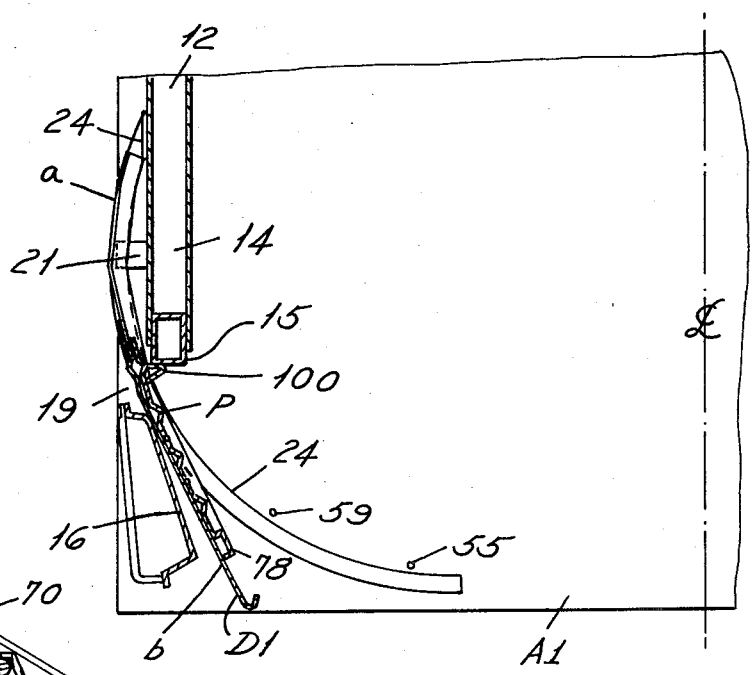
FIG. 6 is similar to FIG. 5 but shows the door in open rather than closed position.

A pair of lugs or stops 100 are provided on the panel P adjacent its outer edge in position to simultaneously engage the post 15 of the main portion 14 of the side wall. These stops are located to engage the post at an intermediate point in the opening movement of the door from the FIG. 5 to the FIG. 6 position, after which the door continues to move to the fully open FIG. 6 position but the panel is prevented from further movement and moves into the stored position fully opening the recess. Hence in the fully open position of the door D1, the recess is open and unobstructed so that the hand brake lever may be operated. As seen in FIG. 6, when the door D1 is open, the inner edge of the panel stops against the door brace 78 and the outer edge of the panel has moved beyond the inner edge of the recess.

There is a flexible linear member in the form of a link chain 102 connected at one end to the post 15 and at the other end to the outer edge of the panel P. This chain is of a length such that when the door D1 moves from the open FIG. 6 position to the closed FIG. 5 position the chain 102 becomes taut at an intermediate point, such movement pulling the panel P into the FIG. 3 position closing the recess. When the door is fully closed the panel fully covers the recess as in FIGS. 3, 4 and 5. In this position, one of the pins 90 engages the stop 94 and one of the rollers 80 engages the stop 76 to prevent the panel from moving outward beyond the position shown.

As stated above, the door D2 may be a mirror image of the door D1 except that it has no recess 23 and of course no covering panel P. Thus the door D2 is shown as being guided for movement by the same structure as employed for the door D1. Similar locking mechanism may be employed.

What I claim as my invention is:

1. A closure for an opening in a rail car comprising a door, means mounting said door on said rail car for movement between open and closed positions relative to said opening, a recess in said door, a panel, means mounting said panel for movement between a closed position relative to said recess and an open position relative to said recess, first panel operating means responsive to movement of said door to its open position for automatically moving said panel to its open position and retaining said panel in said open position when said door is in its open position, and second panel operating means responsive to movement of said door to its closed position for automatically moving said panel to its closed position and retaining said panel in said closed position when said door is in its closed position.

2. An end closure for a rail car comprising an upright door, means mounting said door for lateral movement from a closed position across the end of said rail car to an open position, a recess in said door, a panel, means mounting said panel on said door for movement between a closed position relative to said recess and an open position relative to said recess, panel operating means responsive to movement of said door to its open position for automatically moving said panel to its open position and retaining said panel in said open position when said door is in its open position, and panel operating means responsive to movement of said door to its closed position for automatically moving said panel to its closed position and retaining said panel in said closed position when said door is in its closed position.

3. An end closure as defined in claim 2, wherein said panel mounting means comprises guides mounted on said door to guide said panel for movement laterally between said open and closed positions.

4. An end closure as defined in claim 3, wherein one of said panel operating means comprises a stop on said panel and an abutment on said rail car engageable with said stop.

5. An end closure as defined in claim 3, wherein one of said panel operating means comprises a flexible linear member connected to said panel and to an anchorage on said rail car.

6. An end closure as defined in claim 3, wherein said second panel operating means comprises a flexible linear member connected at one end to said panel and at the opposite end to a fixed anchorage on said rail car, and said first panel operating means comprises a stop on said panel and a fixed abutment on said rail car.

7. An end closure as defined in claim 6, including means for releasably locking said door in its open and closed positions.

8. An end closure as defined in claim 6, wherein said rail car has a hand brake rendered accessible for operation by said recess in the open positions of said door and of said panel.

* * * * *